United States Patent [19]

Nobles, Jr.

[11] Patent Number: 4,930,787

[45] Date of Patent: Jun. 5, 1990

[54] GOLF PUTTER INCLUDING SIGNALING DEVICE

[76] Inventor: Eugene R. Nobles, Jr., 4184 Gwynne Rd., Memphis, Tenn. 38117

[21] Appl. No.: 401,099

[22] Filed: Aug. 31, 1989

[51] Int. Cl.[5] ..... A63B 69/36; G01C 9/06

[52] U.S. Cl. ..... 273/186 A; 273/194 A; 273/162 B; 273/163 R; 33/366; 33/334

[58] Field of Search ..... 273/186 A, 186 C, 183 D, 273/162 R, 162 B, 162 F, 193 R, 194 A, 186 R, 163 R, 163 A, 164; 33/366, 334

[56] References Cited

U.S. PATENT DOCUMENTS

| | | | |
|---|---|---|---|
| 2,158,211 | 5/1939 | Aitken | 273/186 A |
| 2,600,363 | 6/1952 | Morris | 33/366 |
| 3,270,564 | 9/1966 | Evans | 73/432 |
| 3,677,553 | 7/1972 | Moore | 273/186 A |
| 3,753,564 | 8/1973 | Brandell | 273/186 A |
| 3,788,647 | 1/1974 | Evans | 273/186 A |
| 4,082,286 | 4/1978 | La Breche | 273/183 D |
| 4,094,504 | 6/1978 | Barasch | 273/29 A |
| 4,204,332 | 5/1980 | Gray | 273/183 D |
| 4,330,123 | 5/1982 | Kleinerman | 273/54 B |
| 4,506,450 | 3/1985 | Fleming et al. | 33/366 |
| 4,535,986 | 8/1985 | Richards | 273/29 A |
| 4,759,219 | 7/1988 | Cobb | 73/493 |
| 4,789,160 | 12/1988 | Dollar, Jr. | 273/186 A |

*Primary Examiner*—George J. Marlo

*Attorney, Agent, or Firm*—Walker & McKenzie

[57] ABSTRACT

A device for producing a warning signal when a golf club is held with the longitudinal axis of the head thereof unparallel to the ground, or when the putter head undergoes any clockwise or counterclockwise rotation on the backstroke. The device includes a battery; signal structure for producing a signal when electrically energized; electrical circuit for electrically coupling the signal structure to the battery; and switch structure movable between an open position in which electrical energy is prevented from passing from the battery to the signal structure through the electrical circuit and a closed position in which electrical energy is allowed to pass from the battery to the signal structure through the electrical circuit to electrically energize the signal structure, the switch structure being in the closed position when the longitudinal axis of a golf club head is held at an angle unparallel to the horizon, or when the putter head undergoes any clockwise or counterclockwise rotation on the backstroke.

8 Claims, 2 Drawing Sheets

GOLF PUTTER INCLUDING SIGNALING DEVICE

BACKGROUND OF THE INVENTION

1. Field of the Invention:

The present invention relates, in general, to golf clubs and more specifically to a signaling device for use in combination with a putter or the like for helping a golfer avoid rotation of the hands on the backstroke.

2. Information Disclosure Statement:

A preliminary patentability search in class 273, subclasses 183D, 186A, 186C, and 186R in the Examiner's art produced the following patents: Aitken, U.S. Pat. No. 2,158,211; Evans, U.S. Pat. No. 3,270,564; Moore, U.S. Pat. No. 3,677,553; Brandell, U.S. Pat. No. 3,753,564; Evans, U.S. Pat. No. 3,788,647; Barasch, U.S. Pat. No. 4,094,504; Cobb et al., U.S. Pat. No. 4,75,219; Kleinerman, U.S. Pat. No. 4,330,123; Richards, U.S. Pat. No. 4,535,986; and Dollar et al., U.S. Pat. No. 4,789,160. Each of the above patents disclose means for providing information about and/or somehow improving a golf swing or the like and, therefore, appear to relate in general to the present invention. However, none of the above patents disclose or suggest the present Invention. More specifically, none of the above patents disclose or suggest a signaling device including a source of electrical energy, signal means for producing a signal when electrically energized, electrical circuit means for electrically coupling the signal means to the source of electrical energy, and switch means inserted in the electrical circuit means and movable between an open position in which electrical energy is prevented from passing from the source of electrical energy to the signal means through the electrical circuit means and a closed position in which electrical energy is allowed to pass from the source of electrical energy to the signal means through the electrical circuit means to electrically energize the signal means, the switch means being in the closed position when the longitudinal axis of the putter head is held at an angle unparallel to the horizon, or when the putter head undergoes any clockwise or counterclockwise rotation on the backstroke.

SUMMARY OF THE INVENTION

The present invention is directed toward providing a signaling device for improving a golfer's putting stroke or the like. The concept of the present invention is to provide a device for being attached to a golf club or the like which produces a signal during a golf stroke if the longitudinal axis of the head of the golf club is rotated out of parallel with the horizon, when the putter head undergoes any clockwise or counterclockwise rotation on the backstroke, etc.

The signaling device of the present invention includes a source of electrical energy; signal means for producing a signal when electrically energized; electrical circuit means for electrically coupling the signal means to the source of electrical energy; and switch means for being coupled to the golf club head and for being inserted in the electrical circuit means and movable between an open position in which electrical energy is prevented from passing from the source of electrical energy to the signal means through the electrical circuit means and a closed position in which electrical energy is allowed to pass from the source of electrical energy to the signal means through the electrical circuit means to electrically energize the signal means, the switch means being in the closed position when the longitudinal axis of the golf club head is held at an angle unparallel to the horizon.

One object of the present invention is to provide a practice device for improving a golfer's putting stroke.

Another object of the present invention is to train young golfers in the appropriate manner of carrying out a backstroke with the putter and thus hopefully improve their putting style.

DESCRIPTION OF THE PREFERRED EMBODIMENT

Figure 1:
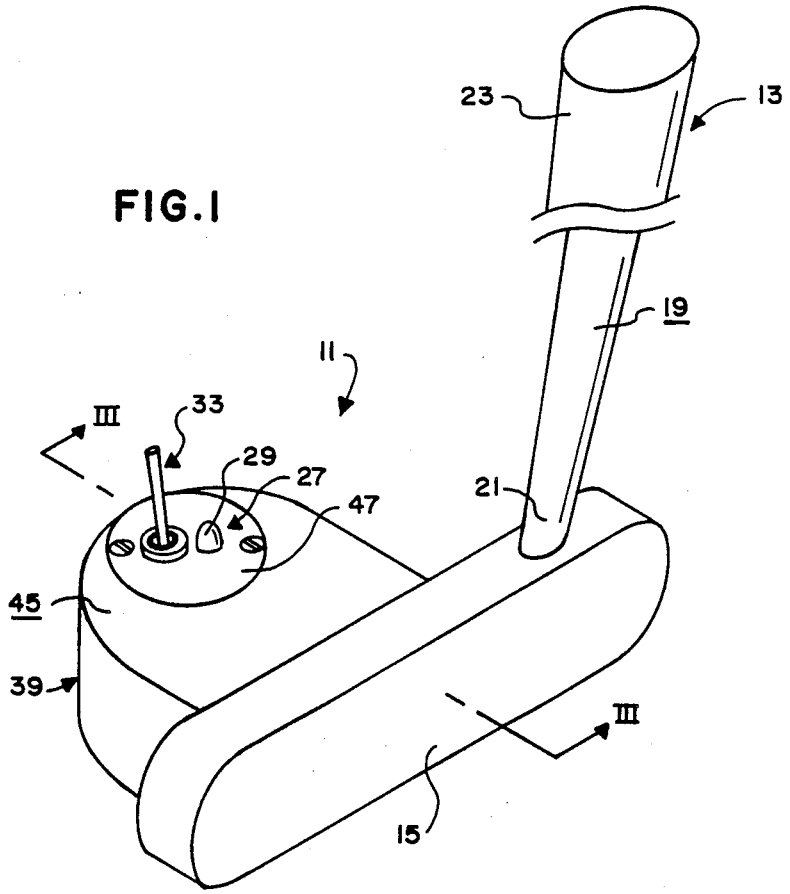
FIG. 1 is a perspective view of the signaling device of the present invention shown combined with a golf putter with portions thereof broken away for clarity.

The preferred embodiment of the signaling device 11 of the present invention is for use with a typical golf putter 13 of any well-known construction. Thus, the golf putter 13 includes a putter head 15 having a longitudinal axis 17 and includes an elongated shaft 19. The shaft 19 has a first end 21 attached to the putter head 15 and a second end 23 remote from the putter head 15 for being gripped by a golfer.

The signaling device 11 includes a source 25 of electrical energy. The source 25 of electrical energy preferably consists of a typical battery such as, for example, a very small lithium Enercell battery marketed by Tandy Corporation of Fort Worth, Tex. through its Radio Shack division as catalog #23-161, having a 3.0 voltage rating.

The signaling device 11 includes signal means 27 for producing a signal when electrically energized. The signal means 27 preferably includes a light means 29 for producing a visible signal when electrically energized. The light means 29 preferably consists of a light emitting diode such as a red super bright LED (for example, the one marketed by Tandy Corporation of Fort Worth, Tex. through its Radio Shack division as catalog #276-088) having a forward voltage of 1.75 volts drawing 20 mA. In practice, it has been found that no resistors are needed between the battery and this particular LED.

Figure 4:
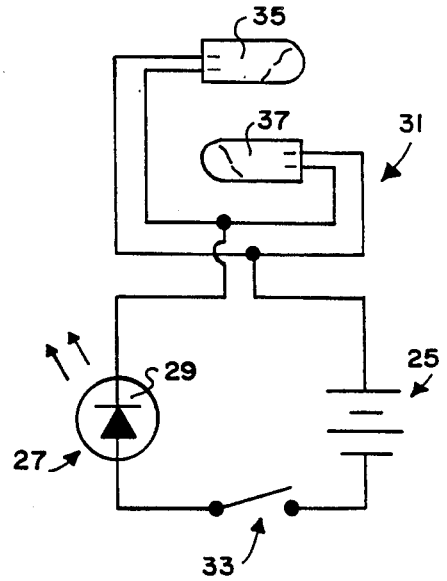
FIG. 4 is an electrical schematic of the electrical components of the signaling device of the present invention.

The signaling device 11 includes electrical circuit means 31 for electrically coupling the signal means 27 to the source 25 of electrical energy. The electrical circuit means 31 is shown schematically in FIG. 4 as consisting of various electrical conductive wires electrically coupling the various electrical components of the signaling device 11 together, although various other specific methods may be used as will now be apparent to those skilled in the art.

Figure 5:
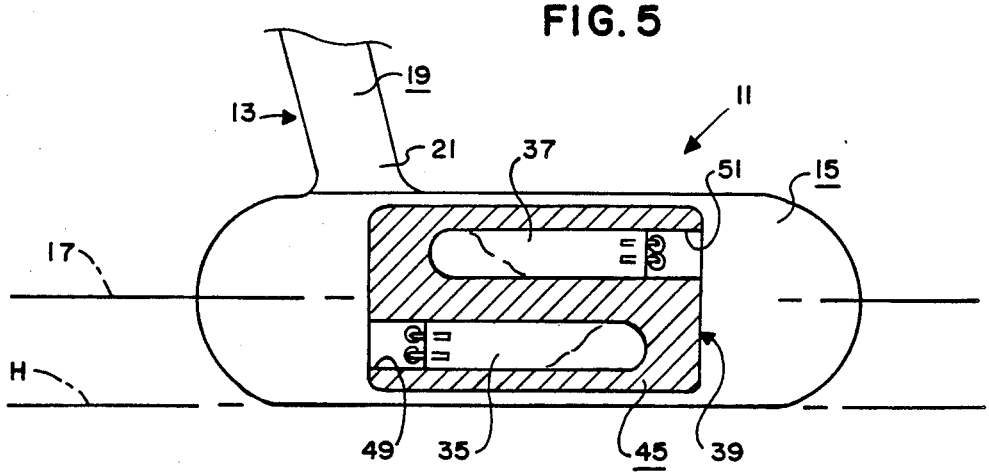
FIG. 5 is a diagrammatic view of a portion of the signaling device of the present invention shown combined with a golf putter with the longitudinal axis of the head of the golf putter held horizontal.
Figure 6:
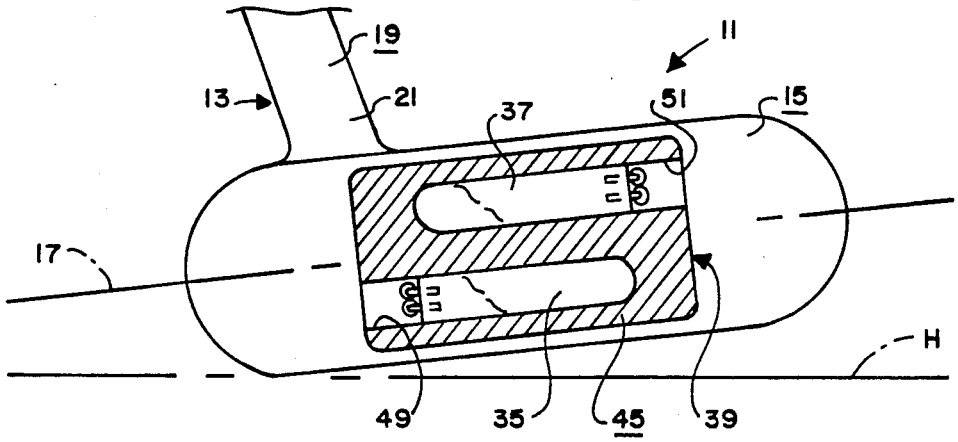
FIGS. 6 and 7 are similar to FIG. 5 but with longitudinal axis of the head of the golf putter held at angles to the horizon.
Figure 7:
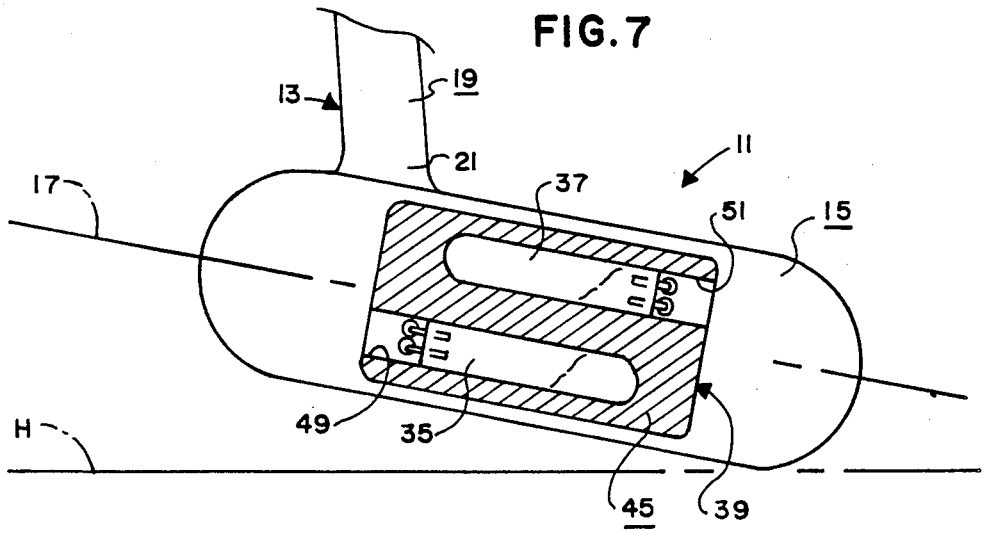

The signaling device 11 includes switch means for being inserted in the electrical circuit means 31 and for controlling the passage of electrical energy through the electrical circuit means 31 from the source 25 of electrical energy to the signal means 27. The switch means preferably includes a master switch 33 inserted in the electrical circuit means 31 between the source 25 of electrical energy and the signal means 27. The master switch 33 preferably consists of a single pole, single throw toggle-type switch that can be manually operated by the user of the signaling device 11 to activate or deactivate the electrical circuit. The switch means preferably includes a first switch means 35 inserted in the electrical circuit means 31 between the source 25 of electrical energy and the signal means 27 and movable between an open position in which electrical energy is prevented from passing from the source 25 of electrical energy to the signal means 27 therethrough and a closed position in which electrical energy is allowed to pass from the source 25 of electrical energy to the signal means 27 therethrough to electrically energize the signal means 27. The switch means preferably includes a second switch means 37 inserted in the electrical circuit means 31 between the source 25 of electrical energy and the signal means 27 and movable between an open position in which electrical energy is prevented from passing from the source 25 of electrical energy to the signal means 27 therethrough and a closed position in which electrical energy is allowed to pass from the source 27 of electrical energy to the signal means 27 therethrough to electrically energize the signal means 27. The first switch means 35 preferably includes a typical mercury bulb switch (such as, for example, the one marketed by Tandy Corporation of Fort Worth, Tex. through its Radio Shack division as catalog #275027) fixedly mounted relative to the longitudinal axis 17 of the putter head 15 so that it will be in the closed position when the longitudinal axis 17 of the putter head 15 is angled upwardly relative to the horizon H as shown in FIG. 6 and in the open position when the longitudinal axis 17 of the putter head 15 is horizontal (i.e., parallel to the horizon H or angled downwardly relative to the horizon as shown in FIGS. 5 and 7. Likewise, the second switch means 37 preferably includes a typical mercury bulb switch (such as, for example, the ones marketed by Tandy Corporation of Fort Worth, Tex. through its Radio Shack division as catalog #275027) fixedly mounted relative to the longitudinal axis 17 of the putter head 15 so that it will be in the closed position when the longitudinal axis 17 of the putter head 15 is angled downwardly relative to the horizon H as shown in FIG. 7 and in the open position when the longitudinal axis 17 of the putter head 15 is horizontal (i.e., parallel to the horizon H) or angled upwardly relative to the horizon H as shown in FIGS. 5 and 6. It should be understood that the terms upwardly and downwardly, etc., relative to the horizon H are relative terms and used herein to indicate the relative movement of the distal end of the putter head 15 (i.e., the end opposite the second end 21 of the shaft 19) relative to the proximal end thereof (i.e., the end adjacent to the second end 21 of the shaft 19 as will now be apparent to those skilled in the art.

Figure 2:
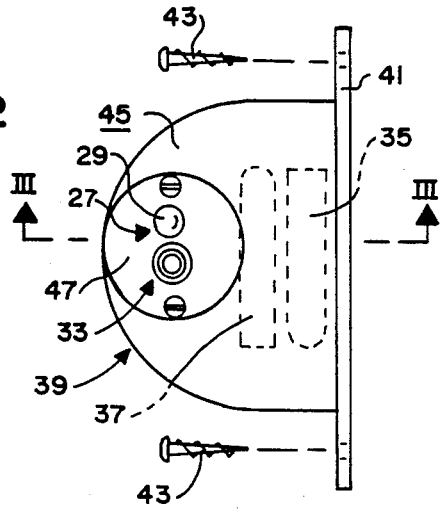
FIG. 2 is a top plan view of the signaling device of the present invention with certain parts thereof in an exploded position.
Figure 3:
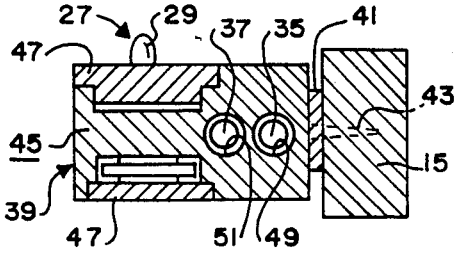
FIG. 3 is a sectional view substantially as taken on line III—III of FIG. 1 with portions thereof omitted for clarity.

The signaling device 11 preferably includes a body 39 for being attached to the putter head 15. The body 39 preferably includes a plate 41 for being attached to the back side of the putter head 15 by screws 43 or the like. The body 39 also preferably includes a housing member 45 for housing the various other components of the signaling device 11. The housing member 45 may consist of a plastic block machined, cast and/or molded to hold the source 25 of electrical energy, the signal means 27, the electrical circuit means 31, the master switch 33, the first switch means 35, and the second switch means 37. The housing member 45 preferably includes removable covers 47 or the like for allowing removal and replacement of the source 25 of electrical energy, etc., in a manner and for reasons as will now be apparent to those skilled in the art. A first aperture 49 is preferably provided in the housing member 45 for receiving the first switch means 35. Likewise, a second aperture 51 is preferably provided in the housing member 45 for receiving the second switch means 37. The apertures 49, 51 may be located in side by side relationship (i.e., spaced apart from one another in a horizontal plane) as shown in FIGS. 2 and 3 or spaced one on top of the other in a vertical plane as shown diagrammatically in FIGS. 5, 6 and 7 etc., as will now be apparent to those skilled in the art. The longitudinal axis of each aperture 49, 51 extends substantially horizontally as shown in FIGS. 5–7 Preferably, each aperture 49, 51 is provided at a very slight (for example, 2 degree) angle from parallel to the ground (i.e., from the longitudinal axis 17 of the putter head 15 when the body 39 is properly attached thereto) in order to normally urge the mercury to the "off" end of the bulb switch as clearly shown in FIG. 5 and as will now be apparent to those skilled in the art.

The operation and use of the signaling device 11 is quite simple. Once the master switch 33 is moved to the on position, the signal means 27 will produce a signal anytime the putter 13 is held with the longitudinal axis 17 of the putter head 15 angled up or down relative to the horizon H. It is generally accepted by golfing experts that one of the major components of an accurate putting stroke is the avoidance of rotation of the hands on the backstroke. The putter head 15 should remain perpendicular to the line of the flight of the ball or "square" to the hole throughout the entire stroke. If, on the backstroke, the golfer imparts to the putter head 15 any rotational forces, the forward stroke is considerably handicapped by having the stroke begin from an abnormal position. In order to maintain an absolutely perpendicular stroke, it is necessary that the wrists remain stiff, that there be no band rotation either in the backstroke or downstroke and that the putter 13 remain close to the putting surface. Golf instructors generally agree that binding the wrists and rotation of the hands on the backstroke results in inconsistency and missed putts. The signalling device 11 is designed to provide a warning signal to the golfer when the putter head 15 has strayed from the proposed line of flight of the ball. In actual practice, the signalling device 11 is mounted on the back edge of the putter blade of head 15 exactly in the center. If there is any rotation whatsoever on the backstroke, one of the switch means 35, 37 will be closed and the signal means 27 will produce a signal. Two switch means 35, 37 are used because there can be rotation errors in either a clockwise or counter clockwise direction on the backstroke. Thus, if the longitudinal axis 17 of the putter head 15 is maintained parallel to the horizon H as shown in FIG. 5 through the swing, both switch means 35, 37 will remain open and no signal will be produced. However, if the golfer rotates his wrists so that the longitudinal axis 17 of the putter head 15 rotates in a clockwise direction or upwardly relative to the horizon as shown in FIG. 6 the first switch means 5 will close and the signal means 27 will produce a signal. Likewise, if the golfer rotates his wrists so that the longitudinal axis 17 of the putter head 15 rotates in either a counter clockwise direction or downwardly relative to the horizon H as shown in FIG. 7, the second switch means 37 will close and the signal means 27 will produce a signal.

This invention ensures that at the top of the backstroke the putter head bears the same relationship to the proposed line of flight as it did when the golfer began the backstroke.

Although the present invention has been described and illustrated with respect to a preferred embodiment and a preferred use therefor, it is not to be so limited since modifications and changes can be made therein which are within the full intended scope of the invention.

I claim:

1. The combination with a golf putter of a signaling device, said golf putter including a putter head having a longitudinal axis and including a shaft having first end attached to said putter head and having a second end remote from said putter head for being gripped by a golfer; said signaling device comprising:

(a) a source of electrical energy;

(b) signal means for producing a signal when electrically energized;

(c) electrical circuit means for electrically coupling said signal means to said source of electrical energy; and (d) switch means inserted in said electrical circuit means and movable between an open position in which electrical energy is prevented from passing from said source of electrical energy to said signal means through said electrical circuit means and a closed position in which electrical energy is allowed to pass from said source of electrical energy to said signal means through said electrical circuit means to electrically energize said signal means, said switch means being in said closed position when said longitudinal axis of said putter head is held at an angle unparallel to the horizon or when said putter head undergoes any clockwise or counterclockwise rotation on the backstroke.

2. The combination of claim 1 in which said switch means includes a first switch means inserted in said electrical circuit means and movable between an open position in which electrical energy is prevented from passing from said source of electrical energy to said signal means therethrough and a closed position in which electrical energy is allowed to pass from said source of electrical energy to said signal means therethrough to electrically energize said signal means, said first switch means being in said closed position when said longitudinal axis of said putter head is angled upwardly relative to the horizon.

3. The combination of claim 2 in which said switch means includes a second switch means inserted in said electrical circuit means and movable between an open position in which electrical energy is prevented from passing from said source of electrical energy to said signal means therethrough and a closed position in which electrical energy is allowed to pass from said source of electrical energy to said signal means therethrough to electrically energize said signal means, said second switch means being in said closed position when said longitudinal axis of said putter head is angled downwardly relative to the horizon.

4. The combination of claim 3 in which said signaling device includes a body for being attached to said putter head; in which said first switch means includes a mercury switch attached to said body; and in which said second switch means includes a mercury switch attached to said body.

5. The combination of claim 4 in which said signal means includes a master switch for producing a visible signal when electrically energized.

6. The combination of claim 5 in which said switch means includes a master switch inserted in said electrical circuit means and movable between an open position in which electrical energy is prevented from passing from said source of electrical energy to said signal means and a closed position in which electrical energy is allowed to pass from said source of electrical energy therethrough.

7. The combination of claim 6 in which said master switch is a single pole, single throw switch.

8. The combination of claim 6 in which said light means is a light emitting diode.

* * * * *